US006904773B1

(12) United States Patent
Cushman

(10) Patent No.: US 6,904,773 B1
(45) Date of Patent: Jun. 14, 2005

(54) KNITTING NEEDLE AND STORAGE CONTAINER COMBINATION

(76) Inventor: Mary Cushman, 33241 Paseo Molinos, San Juan Capistrano, CA (US) 92675

( * ) Notice: Subject to any disclaimer, the term of this patent is extended or adjusted under 35 U.S.C. 154(b) by 0 days.

(21) Appl. No.: 10/921,253

(22) Filed: Aug. 19, 2004

(51) Int. Cl.[7] ..... D04B 35/02
(52) U.S. Cl. ..... 66/1 A; 66/117
(58) Field of Search ..... 66/1 R, 1 A, 116, 66/117, 118; 223/102, 103, 104; 163/2

(56) References Cited

U.S. PATENT DOCUMENTS

| | | | | | |
|---|---|---|---|---|---|
| 229,402 | A | * | 6/1880 | Haff | 66/118 |
| 2,246,254 | A | * | 6/1941 | Johnston | 66/118 |
| 2,341,403 | A | | 2/1944 | Williams | |
| 2,443,540 | A | | 6/1948 | Lewis | |
| 2,720,095 | A | * | 10/1955 | Ernst | 66/117 |
| 2,748,582 | A | * | 6/1956 | Hadler | 66/117 |
| 2,807,945 | A | * | 10/1957 | Carlson | 66/117 |
| 3,927,538 | A | * | 12/1975 | Martella | 66/117 |
| D271,062 | S | | 10/1983 | Okada | |
| 4,494,387 | A | | 1/1985 | Phipps et al. | |
| D298,698 | S | | 11/1988 | Okada | |
| 4,846,351 | A | | 7/1989 | Gardiner | |

* cited by examiner

*Primary Examiner*—Danny Worrell
(74) *Attorney, Agent, or Firm*—John D. Gugliotta; Olen L. York, III

(57) ABSTRACT

A combination knitting needle and storage container is a set of knitting needles which are stored inside of one another by nesting of subsequently smaller needles within the larger needles, and intended to aid in the storage of knitting needles as well as reduce storage space. The largest needle in each set is equipped with a removable threaded cap, while the remaining needles in the set are equipped with an open ring on their top end. The ring allows for the detainment of the knitted article, yet allows smaller needles to be inserted inside of another. The use of the combination knitting needle and storage container allows users to store, transport, and keep track of their knitting needles in a manner, which is quick, easy and effective.

13 Claims, 5 Drawing Sheets

KNITTING NEEDLE AND STORAGE CONTAINER COMBINATION

RELATED APPLICATIONS

The present invention was first described in Disclosure Document Registration 546,248 filed on Jan. 14, 2004 under 35 U.S.C. §122,37 C.F.R. §1.14 and MPEP § 1706. There are no previously filed, or currently any co-pending applications, anywhere in the world.

BACKGROUND OF THE INVENTION

1. Field of the Invention

The present invention relates generally to knitting needles and, more particularly, to a combination knitting needle and storage container, wherein the a longest knitting needle accommodates nesting of a plurality of smaller knitting needles therein for convenient and organized storage of a set of needles.

2. Description of the Related Art

The hobby of knitting has remained popular throughout time. Not only do many people find it relaxing and enjoyable, but the resulting clothes and products can save a great deal of money for the benefit of household budgets. The most common, if not the only tool used in knitting, is the knitting needle. Such needles are made in varying widths to produce the multitude of intricate stitches used in knitting. However, keeping track of and storing such needles quickly becomes a chore. Those who carry their knitting with them throughout their day are burdened with carrying multiple needles, and if they only carry a few, the quality of their work may suffer. Accordingly, there is a need for a means by which one can store, transport and organize multiple sized knitting needles.

A search of the prior art did not disclose any patents that read directly on the claims of the instant invention; however, the following references were considered related:

U.S. Pat. Nos. Des. 271,062 and 298,698, each issued in the name of Okada, disclose an ornamental design for a knitting needle;

U.S. Pat. No. 2,443,540, issued in the name of Lewis, discloses a knitting pin having a cylindrical rod with a head that includes two flat parallel front and rear faces;

U.S. Pat. No. 2,246,254, issued in the name of Johnston, discloses a crochet set having an elongated hollow member open at one end, a removable cap, an outer portion of the cap having a restricted opening, and a crochet hook insertible through aligned openings;

U.S. Pat. No. 2,341,403, issued in the name of Williams, discloses a luminous knitting needle comprised of a plastic material impregnated with luminous material;

U.S. Pat. No. 4,494,387, issued in the name of Phipps et al., discloses an interchangeable kitting needle system having kitting needles with engageable and releasably securing locking means capable of resilient securement with tube adaptor means; and U.S. Pat. No. 4,846,351, issued in the name of Gardiner, discloses a knitting and crochet needle kit having at least two kitting needle shafts, two primary short shafts, two secondary short shafts and a container holding the shafts.

Consequently, there exists a continuous need for new ideas and enhancements for existing products in the knitting industry.

SUMMARY OF THE INVENTION

It is therefore an object of the present invention to provide an improved knitting needle system or combination of knitting needle with storage cavities for nesting a plurality or set of needles therein.

It is a feature of the present invention to provide a longest needle with a hollow shaft for receiving a smaller needle, and wherein subsequently smaller needles also include hollow shafts for receiving sequentially descending needle sizes therein, thus conveniently storing an entire set of knitting needles within a longest needle.

Briefly described according to one embodiment of the present invention, a combination knitting needle and storage container is a set of knitting needles which are stored inside of one another by nesting of subsequently smaller needles within the larger needles. This feature is intended to aid in the storage of knitting needles as well as reduce storage space. The invention is envisioned to hold a total of six needles from smallest to largest. If additional sizes are needed, two or more sets will be utilized. The largest needle in each set is equipped with a removable threaded cap, while the remaining needles in the set are equipped with an open ring on their top end. The ring allows for the detainment of the knitted article, yet allows smaller needles to be inserted inside of another. The use of the combination knitting needle and storage container allows users to store, transport, and keep track of their knitting needles in a manner, which is quick, easy and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
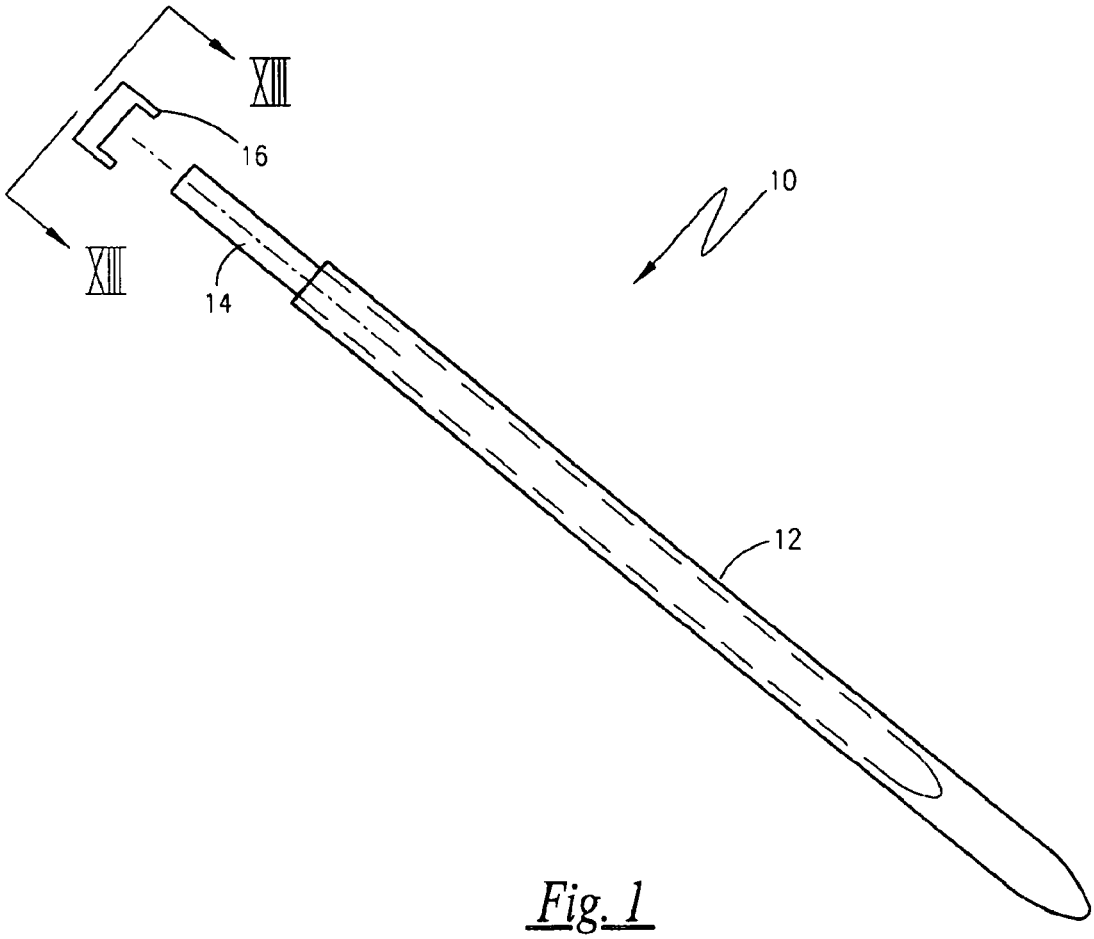
FIG. 1 is perspective view of a knitting needle system or knitting needle and storage container combination, wherein subsequently smaller needles are nested within the larger needles and sealed or enclosed with a cap on the largest/longest needle.

The best mode for carrying out the invention is presented in terms of its preferred embodiment, herein depicted within FIGS. 1 through 8.

1. Detailed Description of the Figures

Referring to FIG. 1 through FIG. 8, a knitting needle system 10 (hereinafter "system") is shown in accordance with a preferred embodiment of the present invention. The system 10 may be described as a system of nestable knitting needles or a combination of knitting needles and storage containers for achieving nestability between subsequent knitting needles. The system 10 comprises a plurality of knitting needles having a longest needle 12 and incrementally shorter (or descending in size from largest and longest to smallest and shortest) needles 14. In one envisioned embodiment, the longest needle is of the standard size for knitting needle (14 inches) and descending in size by approximately one-half inch sequentially in the series. The incremental reduction in size (diameter and length) permits subsequently smaller and shorter needles to nest within the next larger and longer needle, thus permitting nestability of the entire plurality of needles provided into a convenient large needle storage system 10, providing organized storage and optimal transportability. The system 10 includes at least one removable cap 16 selectively secured or removed from an end of the largest/longest needle 12. The cap 16 operates to enclose the smaller, nested needles 14 of the series or set within the largest/longest needle 12 for secure storage and organization.

Figure 2:
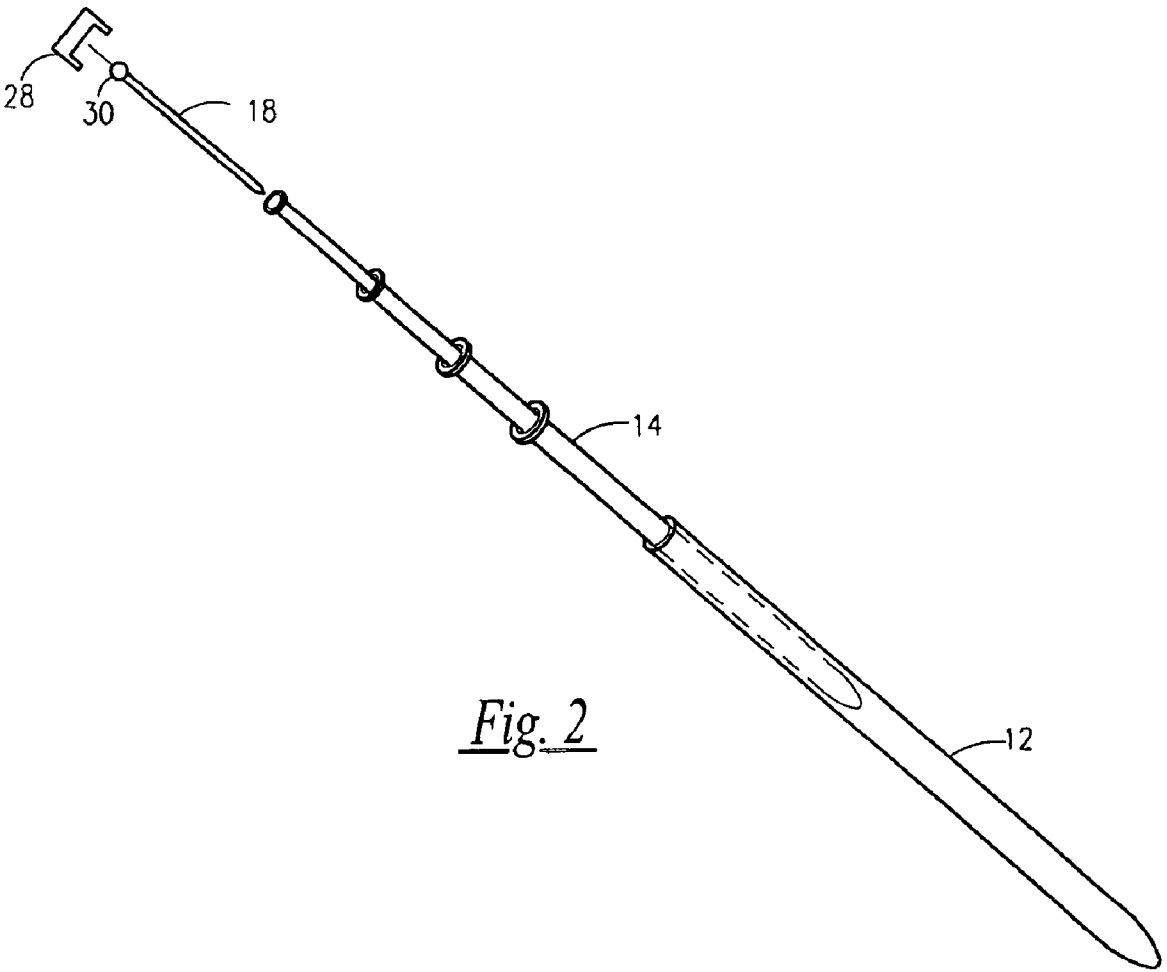
FIG. 2 is an exploded perspective of a longest needle, at least one intermediate needle and a shortest needle.
Figure 3:
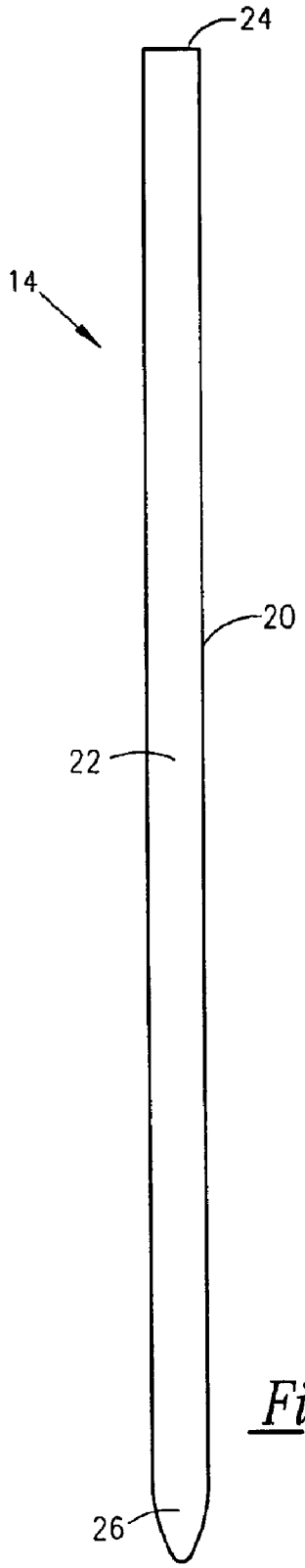
FIG. 3 is a front view of the longest and/or intermediately sized needles.
Figure 4:
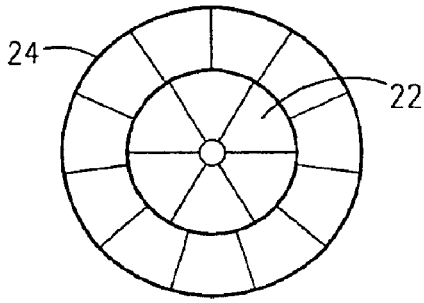
FIG. 4 is a top view of FIG. 3 indicating the cavity formed by the shaft of the needle.
Figure 5:
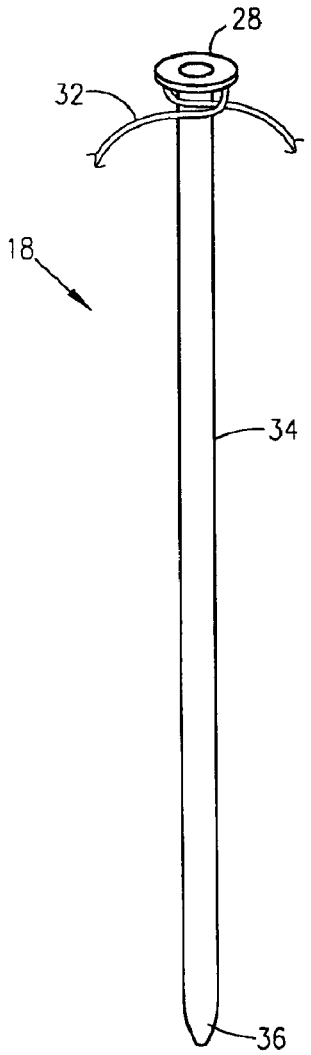
FIG. 5 is a front view of the shortest needle having a solid shaft and an eyelet for detaining thread after use.

The plurality of needles comprises a longest needle 12, a plurality of intermediate needles 14 and a shortest needle 18 (see FIG. 2). Referring specifically to FIG. 3 and FIG. 4, the longest needle 12 and each one of the intermediate needles 14 have a shaft 20 having a hollow or longitudinal storage cavity 22 defined by an annular head 24 providing ingress and egress to the hollow or cavity 22. The hollow or cavity 22 accommodates a smaller/shorter needle for nesting or storage therein. The shaft 20 terminates in a tapered end 26 opposite the annular head 24. Each of the intermediate needles 14 may have an annular ring 28 for allowing a needle 14 to insert therethrough and nest within the larger needle. As depicted in FIG. 5, the ring 28 is provided at the ends for detainment of the threading 32 during and after use. The shortest needle 18 has a solid shaft 34 terminating at a tapered end 36 and having a ring 28 (see FIG. 5) or a solid head 30 (see FIG. 2). The plurality of needles may comprise a variety of sets or series, including the common knitting needle series of 15, 13, 11, 9, 7 and 5 gauge needle sizes. It is also envisioned that a series of 16.5, 14.5, 12.5, 10.5, 8.5 and 6.5 gauge needle sizes, among other variations.

Figure 6:
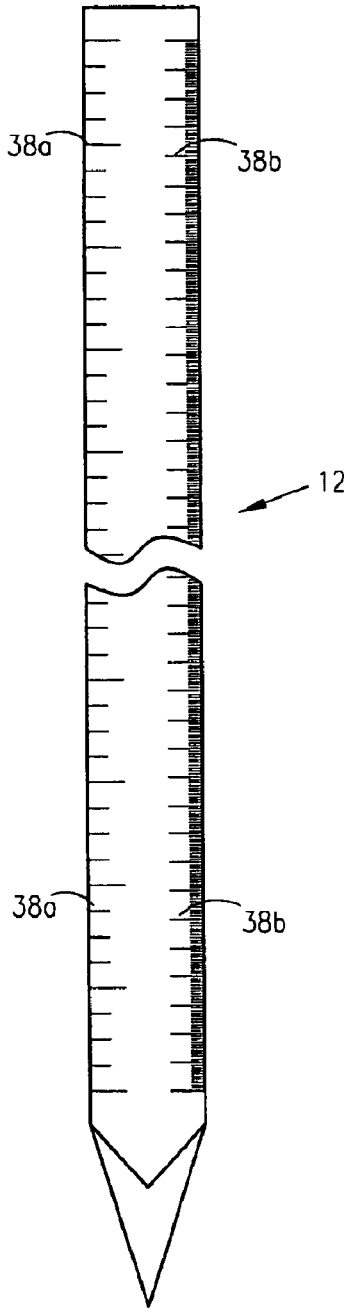
FIG. 6 is a perspective view depicting measurement markings along the shaft.

Referring specifically to FIG. 6, the longest needle 12 may have measurement markings 38 imprinted along a length thereof (such as along the shaft). The markings 38 may be imprinted at increments 38*a* of 0.25 inches up to 12 inches of length. Likewise, the markings 38 may be imprinted at increments 38*b* of one millimeter up to 30 centimeters in length. The markings 38 provide the user an easy and convenient method of measuring fabric for cutting, measuring the dimensions of an article of clothing, or other items that require measuring during the knitting process.

Figure 7:
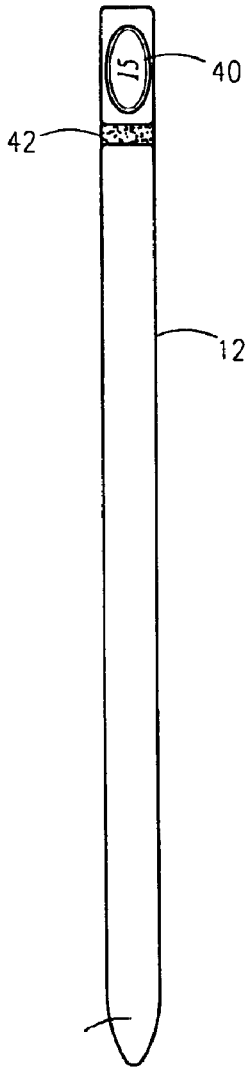
FIG. 7 is a front view depicting numerical indicia and/or color indicia for identifying particular needles or needle sets.
Figure 8:
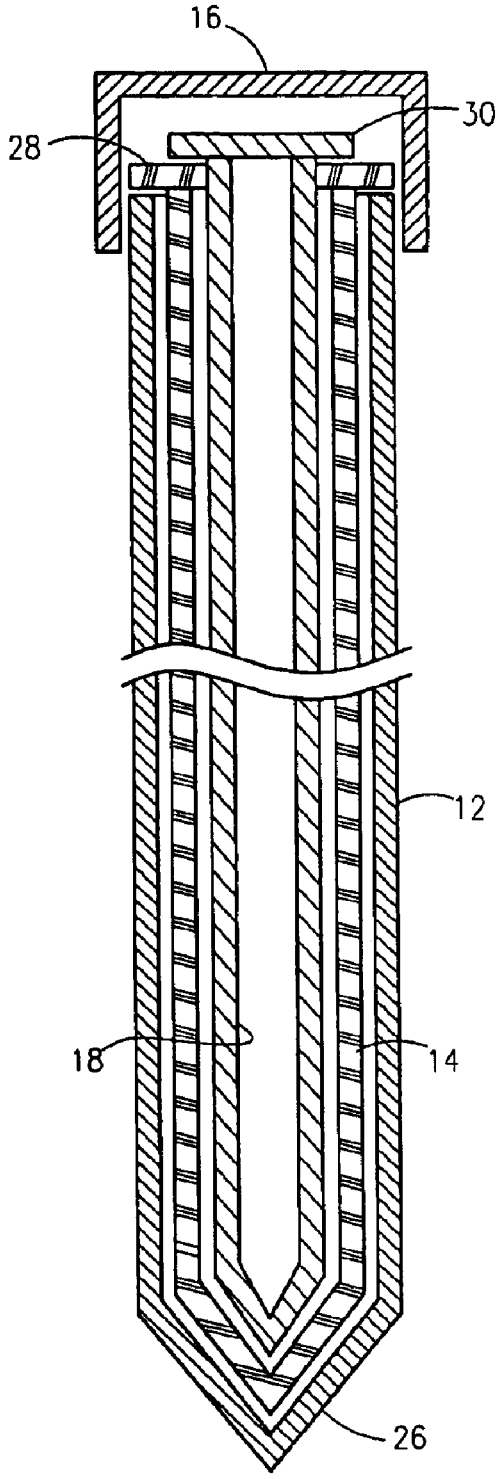
FIG. 8 is a sectional view of FIG. 1 taken along line XIII—XIII.

Referring specifically to FIG. 7, the needles 12, 14 and 18 may have numerical indicia 40 imprinted on the needle for convenient identification of the needle gauge/size. Alternatively, color indicia 42 may be imprinted on the needle for identifying a specific needle gauge/size or for identifying a common series or set of needles. Any color(s) may be incorporated into this identification method. The numerical indicia 40 and the color indicia 42 may be used separately or in combination.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the preferred embodiment of the present invention, a user will select the appropriately gauge/size of knitting needle, and (if necessary) remove the cap 16 and locate the appropriate size among the needles 14 or 18 nested within the largest/longest needle 12 (the storage needle). After use, the needle 14 or 18 is returned to the appropriate nesting location, with the cap 16 returned to the largest/longest needle 12 for enclosing the needles 14 and 18 therein.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A knitting needle system comprising:

a longest knitting needle, a plurality of intermediate knitting needles and a shortest knitting needle;

said longest knitting needle and each one of said intermediate knitting needles having a hollow shaft terminating at a tapered end and having a removable cap at an opposing end;

said plurality of intermediate knitting needles incrementally shorter in length, thereby allowing nesting of said needles; and said shortest needle having a solid shaft terminating at a tapered end.

2. The system of claim 1, wherein said longest needles has measurement markings imprinted thereon.

3. The system of claim 2, wherein said measurement markings are imprinted at increments of 0.25 inches up to 12 inches.

4. The system of claim 2, wherein said measurement markings are imprinted at increments of one millimeter up to thirty millimeters.

5. The system of claim 1, wherein said needles have numerical indicia imprinted thereon representing a respective needle size.

6. The system of claim 1, wherein said needles comprise a set having gauge sizes of 15, 13, 11, 9, 7 and 5.

7. The system of claim 1, wherein said needles comprise a set having gauge sizes of 16.5, 14.5, 12.5, 10.5, 8.5 and 6.5.

8. A combination knitting needle and storage container comprising:

a plurality of knitting needles incrementally descending in size;

each one of said needles having an annular head and a linearly elongated shaft terminating at a tapered end, said annular head and said shaft defining a longitudinal storage cavity adapted for slidably accommodating a shaft of a subsequently smaller size needle;

a removable cap enclosing said needles within a longest needle.

9. The combination of claim 8 further comprising an annular ring formed at said annular head, said ring detaining thread.

10. The combination of claim 8 further comprising measurement markings imprinted on said longest needle in fractional inches and centimeters for measuring material.

11. The combination of claim 8 further comprising numerical indicia imprinted on each one of the said needless, said indicia representing a respective needle size.

12. The combination of claim 8 further comprising a specific color assigned to a needle set having gauge sizes of 15, 13, 11, 9, 7 and 5.

13. The combination of claim 8 further comprising a specific color assigned to a needle set having gauge sizes 16.5, 14.5, 12.5, 10.5, 8.5 and 6.5.

* * * * *